United States Patent [19]

Black

[11] 4,193,967

[45] Mar. 18, 1980

[54] LIQUID SEALING APPARATUS FOR SEALING VAPORS IN A TANK

[75] Inventor: James L. Black, Houston, Tex.

[73] Assignee: Merichem Company, Houston, Tex.

[21] Appl. No.: 951,541

[22] Filed: Oct. 16, 1978

[51] Int. Cl.[2] ..... B01D 47/02; B01D 47/06; F16L 43/00

[52] U.S. Cl. ..... 422/170; 55/223; 55/213; 55/227; 55/229; 55/248; 55/266; 55/270; 55/314; 55/355; 137/247.25

[58] Field of Search ..... 55/212, 213, 223, 227, 55/229, 248, 256, 270, 250, 314, DIG. 20, 385 C, 313, 261, 266, 355; 261/119 R; 137/247.25, 252-254; 422/170

[56] References Cited

U.S. PATENT DOCUMENTS

| | | | |
|---|---|---|---|
| 1,172,884 | 2/1916 | Gungerich | 220/88 B |
| 2,527,004 | 10/1950 | Fett | 55/248 |
| 2,585,440 | 2/1952 | Collins | 55/223 |
| 2,870,862 | 1/1959 | Norment | 55/227 |
| 3,041,841 | 7/1962 | Henry | 220/88 B |
| 3,126,906 | 3/1964 | Touzalin et al. | 137/253 |
| 3,321,191 | 5/1967 | Najarian | 261/119 R |
| 3,485,015 | 12/1969 | Vecchio | 55/248 |
| 3,609,945 | 10/1971 | Saradzhev | 55/250 |
| 3,741,235 | 6/1973 | Ambrose et al. | 55/355 |
| 3,831,619 | 8/1974 | Schmidt | 137/254 |

OTHER PUBLICATIONS

Brighton Corp.; Bulletin M-511, M-1165 and Spec. 40001; 3-79; *Wet Scrubber.*

*Primary Examiner*—Frank W. Lutter
*Assistant Examiner*—Gregory N. Clements
*Attorney, Agent, or Firm*—Fulbright & Jaworski

[57] ABSTRACT

A liquid sealing apparatus for attachment to a tank having vapor having a liquid seal for providing containment of the vapor throughout a range of tank pressure. An inert gas supply may be provided to maintain the pressure in the tank at a predetermined point and a diluting fluid supply may be provided with a bypass connection around the sealing apparatus for admission of the diluting fluid upon predetermined high and low pressures in the tank. A scrubber may be attached to the apparatus for treating vapors which break through the liquid seal on an increase in pressure in the tank. The liquid sealing apparatus may include an enclosure having first, second and third liquid compartments separated by partitions with a liquid trap connected to the first and third compartments for maintaining liquid therein, and having first and second gas compartments above the fluid compartments separated by a third partition positioned in the liquid in the second fluid compartment providing a liquid seal. A first port in the first gas compartment is adapted for connection to the tank and a second port is connected to the second gas compartment to provide a passage for vapors from the sealing apparatus and for admission of diluting fluid.

8 Claims, 3 Drawing Figures

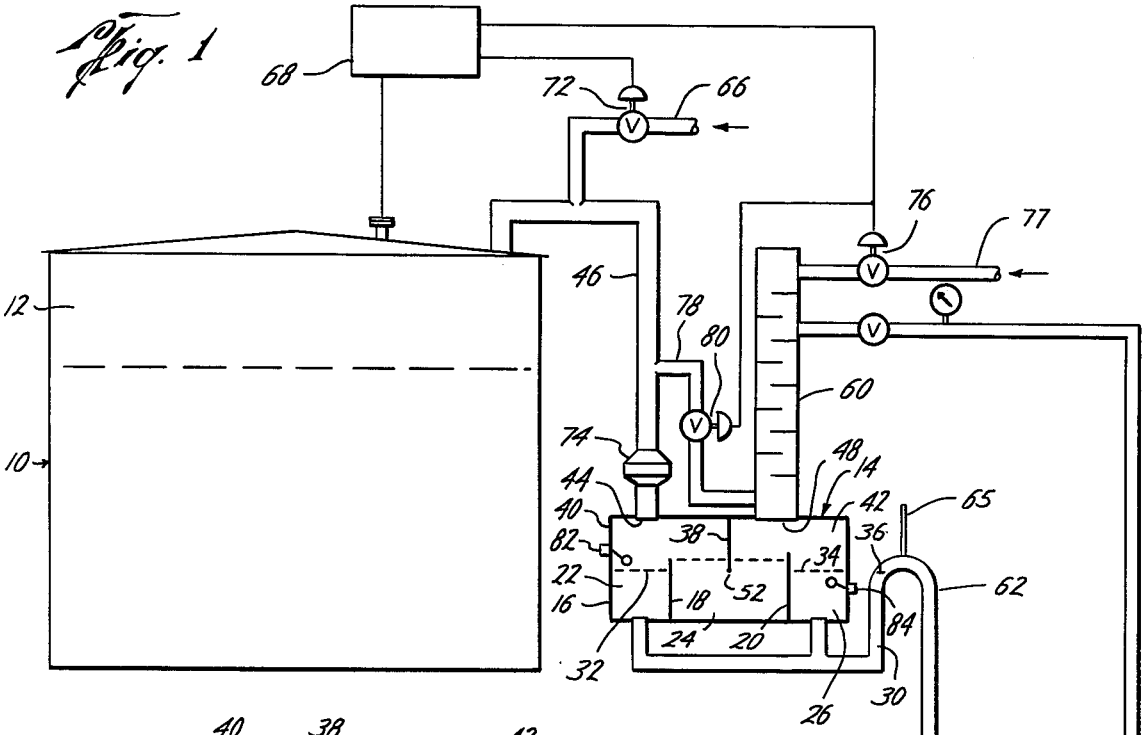
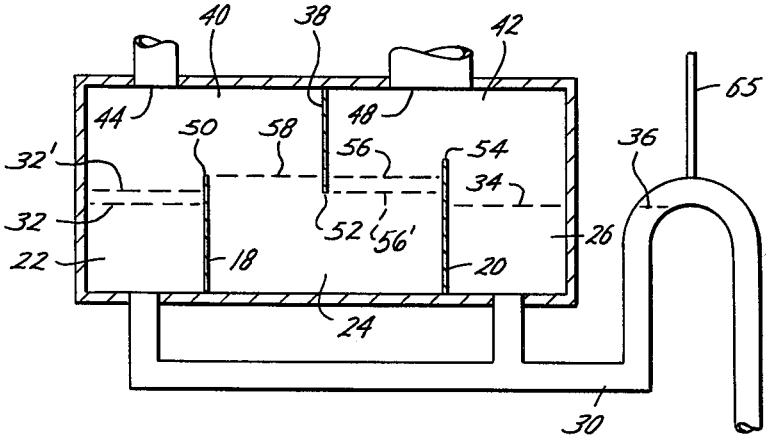
Fig. 2
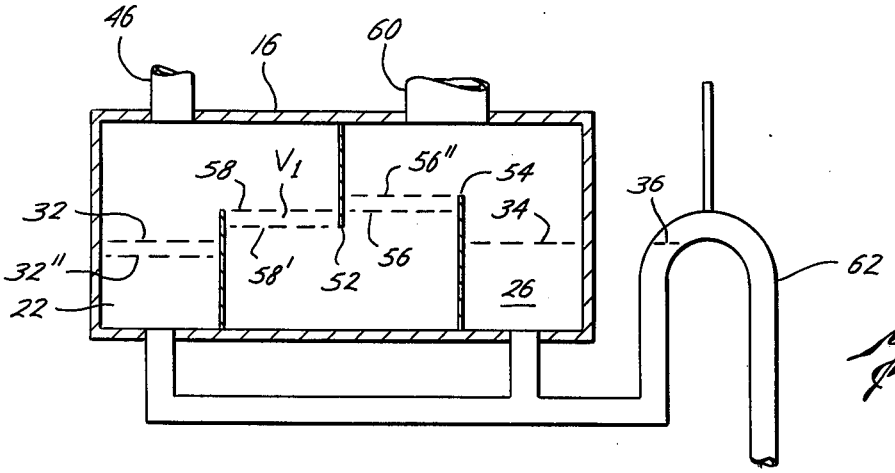
Fig. 3

LIQUID SEALING APPARATUS FOR SEALING VAPORS IN A TANK

BACKGROUND OF THE INVENTION

It is necessary to achieve a near perfect seal against release of vapors from a tank, particularly where the vapors may be toxic, odorous or flammable, while at the same time limiting pressure increases in the tank. That is, it is necessary to prevent the release of undesirable vapors to the atmosphere under static conditions as well as when the tank is being filled or is subjected to increasing pressure due to increasing temperatures. It is also necessary in some situations to prevent reducing the pressure in the tank to a low negative pressure which could cause the tank to collapse and it is desirable to prevent pulling atmospheric air into a tank for safety reasons which may occur when the tank is being emptied or the tank temperature falls. Conventional mechanical seals are subject to seepage and/or failure as they become worn, old, or are subject to chemical attack.

The present invention is directed to a liquid sealing apparatus for sealing vapors in a tank utilizing liquid seals.

SUMMARY

The present invention is directed to a liquid sealing apparatus which includes an enclosure having first and second liquid partitions dividing the bottom portion of the enclosure into first, second and third liquid compartments. A liquid trap is connected to the first and third compartments for maintaining a liquid therein. A third partition is positioned in the enclosure dividing the upper portion of the enclosure into first and second gas compartments above the liquid compartments and extends into the liquid in the second liquid compartment to provide a liquid seal under a certain range of pressure conditions. A first port is provided in the first gas compartment and adapted for connection to the tank having vapor. A second port is provided in the second gas compartment to allow for the passage of vapors between the atmosphere when the tank pressure reaches the design pressure set points and may provide for the admission of a sealing liquid into the second liquid compartment.

Yet a further object of the present invention is the provision of positioning the vertical extent of the first, second and third partitions to provide a desirable range of sealing pressures in the enclosure. For example, the distance by which the partition between the second and third liquid compartments extends upwardly higher than the bottom edge of the third partition establishes the upper pressure at which the sealing apparatus will contain the vapors in the tank. The distance by which the partition between the first and second liquid compartments extends upwardly higher than the bottom edge of the third partition establishes the lower pressure limit at which the seal will no longer prevent the flow of vapors from the second vapor compartment into the tank.

A still further object is to allow flow of vapors or diluting fluid between the gas compartments in response to pressures outside of the range of designed sealing pressures and to treat the exiting vapors to render it harmless.

Still a further object of the present invention is to provide a scrubber connected to the second port for scrubbing vapor which breaks through the liquid seal in the second liquid compartment.

Yet a still further object of the present invention is the provision of an inert gas supply for connection to the tank for admission of inert gas when the pressure in the tank falls below a predetermined point such as when the tank is being emptied thereby avoiding the admission of air into the tank.

Still a further object of the present invention is the provision of providing a diluting fluid supply, such as steam, connected to the scrubber, and a bypass connection between the tank and the scrubber for admitting the vapors to the scrubber or diluting fluid to the tank if predetermined pressure conditions are experienced.

Yet a still further object of the present invention is the provision of control means responsive to the pressure in the tank for controlling the admission of diluting fluid to the scrubber and controlling the opening of the bypass connection as well as controlling the admission of inert supply gas to the tank.

Other and further objects, features and advantages will be apparent from the following description of a presently preferred embodiment, given for the purpose of disclosure, and taken in conjunction with the accompanying drawings.

BRIEF DESCRIPTION OF THE DRAWINGS

FIG. 1 is a schematic diagram of the liquid sealing apparatus of the present invention connected to a tank, FIG. 2 is an enlarged elevational view of the liquid sealing enclosure of the present invention showing the position of the sealing liquid when the vapor in the tank is a vacuum, and FIG. 3 is an enlarged elevational view of the liquid sealing enclosure of the present invention when the vapor pressure in the tank is positive.

DESCRIPTION OF THE PREFERRED EMBODIMENT

While the present invention is useful in providing a liquid seal from various types of tanks having various types of vapors, the present invention, for purposes of illustration only, will be described in connection with providing a liquid seal from a low pressure American Petroleum Institute tank having hydrogen sulfide vapors in the vapor space. In this example, a near perfect seal is needed since the hydrogen sulfide is toxic, odorous and flammable. Furthermore, in this example, the seal is needed to prevent the admission of air into the tank since the hydrogen sulfide will corrode mild steel to form iron sulfide which is known to be pyrophoric and may spontaneously ignite in the presence of air.

Referring to the drawings, and particularly to FIG. 1, a low pressure American Petroleum Institute tank 10 having a liquid above which is a vapor 12 comprising hydrogen sulfide, which is desired to be sealed from the atmosphere.

A liquid sealing apparatus of the present invention is generally referred to by the reference numeral 14 and basically includes an enclosure 16 for providing a liquid seal between the vapor 12 and the atmosphere and other auxiliary equipment which will be more fully described hereinafter which is useful for the particular application illustrated, but which are not necessary for other applications.

The enclosure 16 includes a first liquid partition 18 and a second liquid partition 20 extending upwardly from the bottom of the enclosure 16 toward but not to the top of the enclosure thereby dividing the bottom of the enclosure 16 into a first liquid compartment 22, a second liquid compartment 24, and a third liquid compartment 26. A liquid trap 30 is connected to the first liquid compartment 22 and the third liquid compartment 26 whereby when the pressure throughout the enclosure 16 is equal, the liquid level 32 in the compartment 22 and liquid level 34 in the compartment 26 will be equal to the liquid level 36 at the top of the liquid trap 30. A third partition 38 is positioned in the enclosure 16 extending downwardly from the top of the enclosure into the second liquid compartment 24 dividing the upper portion of the enclosure 16 into a first gas compartment 40 and a second gas compartment 42. A first port 44 is provided in the first gas compartment 40 adapted for connection such as by a line 46 to the vapor 12 in the tank 10. A second port 48 is connected to the enclosure 16 to provide a means to connect the second gas compartment to the atmosphere so that the pressure in the tank may be relieved.

In order for the liquid in the second liquid compartment 24 to act as a fluid seal between the vapor port 44 and the port 48, which may be the atmosphere, the third partition 38 must extend downwardly into the liquid in the compartment 24. With the partition 38 extending into the liquid in compartment 24, a liquid seal is provided under static conditions. However, the vertical free ends of the partitions 18, 38 and 20 may be positioned as desired, whereby the enclosure 16 forms a liquid seal for a desired range of pressure variations in the tank 10. Assume for example that it is desired to seal the tank 10 from a pressure range of minus one inch of water to a plus two inches of water. Referring now to FIGS. 2 and 3, the free end 50 of the first partition 18 would be positioned one inch above the free end 52 of the third partition 38, and the free end 54 of the second partition 20 would be positioned two inches above the free end 52 of the third partition 38. When the pressure in the gas compartments 40 and 42 is equal, the liquid level 58 and liquid level 56 in the second liquid compartment 24 are the same and the liquid level 58 is at the same level as the free end 50 and thus one inch above the free end 52 and one inch below the free end 54. Referring now to FIG. 2 and assume that a vacuum of one inch of water occurs in the tank 10 and thus at the port 44, the liquid level 56 between partitions 38 and 20 will fall one inch to level 56', the liquid level 58 between the partitions 38 and 18 will remain the same and thus the liquid seal in the liquid compartment 24 reaches its one inch water vacuum limit whereby any further lowering of the pressure in the tank 10 will be prevented because gas in compartment 42 will flow into the gas in compartment 40 and hence into tank 10. At the other extreme, assuming that the tank 10 has a positive pressure of two inches of water, and referring to FIG. 3, the liquid level 56 rises to the free end 54 of the second partition 20, that is to level 56'', while the liquid level 58 drops to the free end 52 of the third partition 38, that is level 58'. The level 34 in the liquid compartment 26 remains unchanged and the level 32 in the compartment 22 drops two inches to level 32'' from its normal static level 32. It is, therefore, noted that the enclosure 16 provides a positive liquid seal in the liquid compartment 24 between the ranges of a minus one inch water to a positive two inches of water. Obviously, the vertical positions of the free ends 50, 52 and 56 of the partitions 18, 38 and 20, respectively, may be suitably varied as required to provide a liquid seal in the enclosure 16 through a desired range of pressure experienced in the tank 10.

In general, liquid partition 18 should extend upwardly so that its free end 50 is higher than the free end 52 of partition 38 by an amount such that the desired pressure relief point on the vacuum side is attained. This distance will depend upon the specific gravity of the liquid employed in the sealing apparatus 16. Likewise, liquid partition 20 should extend upwardly so that its free end 54 is higher than the free end 52 of partition 38 by an amount such that the desired pressure relief point on the pressure side is attained.

The location of liquid partitions 18 and 20 relative to partition 38 should be such that the volume of liquid displaced on the high pressure side of the liquid compartment 24 is measured from its equilibrium pressure level to the level at which the sealing apparatus relieves (level at the bottom edge 52 of partition 38) will cause the liquid level on the low pressure side of liquid compartment 24 to rise to the free end of the liquid partition on that side.

The enclosure 16 may be satisfactory for providing a liquid seal in many applications, such as where the pressure does not vary greatly within the tank 10. Furthermore, the enclosure 16 is also suitable in various applications where the pressure in the tank 10 varies considerably such as during an emptying or filling cycle.

If the admission of air into the tank 10 is undesirable, an inert gas supply 66 can be provided in conjunction with a pressure responsive controller 68 and a control valve 72 whereby the pulling of air into the tank is prevented when a vacuum condition is encountered, as when lowering the liquid level in the tank. If the vapor being emitted from the tank 10 is toxic or odorous and can be scrubbed by a suitable liquid to remove such toxic or odorous components from the vapor, a scrubber 60 may be employed in connection with port 48 as shown in FIG. 1. The liquid employed in the scrubber can also comprise the liquid used in the liquid compartments of enclosure 10.

Now referring to FIG. 2, if the vacuum in the tank 10 falls below the one inch of water, air will be drawn in through the port 48 passed under the partition 38, out the port 44 and into the tank. And if the higher pressure in the tank 10 exceeds plus two inches of water, the vapor will flow through the port 44, under the partition 38, through the scrubbing liquid in the compartment 24 and out the port 48.

Now, referring to FIG. 1 wherein the application being illustrated involves a tank in which the vapor contains hydrogen sulfide, and it is desirable to utilize auxiliary equipment along with the enclosure 16 to prevent release of hydrogen sulfide to the atmosphere and to prevent pulling air into the tank 10. For the application illustrated in FIG. 1, the enclosure 16 is designed as illustrated in FIGS. 2 and 3, to have a sealing range of minus one inch of water to a plus two inches of water. If, however, positive pressures greater than two inches of water are experienced, such as when the tank 10 is being filled, the displaced vapor breaks through the liquid seal in the compartment 24 and exits through the port 48. However, a conventional caustic scrubber 60 is provided at the port 48 for receiving the displaced vapor, treating it with caustic, whereby the resulting vent stream from the scrubber 60 is relatively free of noxious hydrogen sulfide. The liquid caustic used for scrubbing flows through the port 48 into the liquid sealing compartment 24 and serves as the sealing liquid before passing out of the liquid compartments 22 and 26, through the liquid trap 30, and out through a line 62 to a pump 64 where it is recycled to the scrubber 60. At the top of exit line 62, a siphon breaker 65 is provided to prevent siphoning the trap 30 and its connected liquid compartments.

As has been previously mentioned, it is undesirable that air be allowed to enter the tank because of the danger of ignition. Therefore, an inert gas supply 66 is provided in communication to the tank 10 for admission of inert gas when the pressure in the tank falls below a predetermined point. For example only, a controller 68 which is connected to the tank 10 by line 70 is responsive to pressure therein and controls a valve 72 in the inert gas supply line 66. The controller is set at any suitable point, such as a plus one inch of water, whereby when the pressure in the tank 10 falls below the set point, inert gas will be admitted into the tank 10 thereby protecting the tank 10 from physical collapse and from admission of air therein, particularly while the tank 10 is being emptied. As an additional protection for the handling of flammable vapors such as hydrogen sulfide or hydrocarbon, a conventional flame arrester 74 may be provided in the line 46 which may be of any suitable type such as sold by Varec as model FIG. 50 for preventing any downstream flame from entering the tank 10. As an additional protection in the event that there exists any obstruction of the sealing device 16 or the flame arrester 74 such that the pressure in tank 10 exceeds a certain set point, that is, minus three inches of water or a plus four inches of water, the controller 68 actuates valve 80 in a bypass line 78 to bypass the flame arrester 74 and enclosure 16 and at the same time controller 68 actuates valve 76 and a diluting fluid supply, such as steam or carbon dioxide flows into the scrubber 60 to dilute the vapors to prevent possible ignition of the vapors and flash back into the tank 10 since the flame arrester 74 is bypassed. Additional safety equipment may be utilized such as a high level liquid measuring instrument 82 positioned in the liquid compartment 22 to avoid the possibility that the scrubbing liquid does not properly drain from the vessel and begins backing up into the vent lines thus undesirably raising the release pressure, and a low level alarm liquid measuring instrument 84 positioned, such as in compartment 26, for insuring that an adequate supply of scrubbing liquid is available.

While the present liquid sealing apparatus has been described in conjunction with sealing hydrogen sulfide in a tank, the present invention is useful in providing a liquid seal apparatus for many other types of vapors and which can contain the vapors by means of the enclosure 16 without requiring other auxiliary equipment such as the inert gas supply 66, flame arrester 74, scrubber 60, diluting fluid supply 77, and bypass 78. However, in other applications, other kinds of liquids may be preferable for forming the liquid seal in the enclosure 16 or in providing the scrubbing fluid in the scrubber 60. By way of example only, ammonia vapors and liquid hydrochloric vapors may use water as a scrubbing material.

The present invention, therefore is well adapted to carry out the objects and attain the ends and advantages mentioned as well as others inherent therein. While a presently preferred embodiment of the invention is given for the purpose of disclosure, numerous changes in the details of construction and arrangement of parts will readily suggest themselves to those skilled in the art and which are encompassed within the spirit of the invention and the scope of the appended claims.

What is claimed is:

1. A liquid sealing apparatus for attachment to a tank having vapor therein for sealing the vapors comprising, an enclosure, first and second liquid partitions positioned in the enclosure extending upwardly from the bottom of the enclosure toward but not to the top of the enclosure dividing the enclosure into first, second and third liquid compartments for receiving a sealing liquid, a liquid trap connected to the first and third liquid compartments for maintaining liquid therein and preventing escape of gas, a third partition positioned in the enclosure extending downwardly from the top of the enclosure into the second liquid compartment dividing the enclosure into first and second gas compartments above the fluid compartments whereby gas can flow between said gas compartments only in response to certain pressure differences, a first port in the first gas compartment adapted for connection to said tank having vapor, a second port connected to the second gas compartment for admission and exit of gas from the second gas compartment, a gas scrubber connected to the second port for scrubbing vapor flowing into the first port and into the second gas compartment, and supplying sealing liquid through the second port to the second fluid compartment, and a liquid connection between the liquid trap and the gas scrubber for recycling scrubbing liquid.

2. A liquid sealing apparatus for attachment to a tank having vapor therein for sealing the vapors comprising, an enclosure, first and second liquid partitions positioned in the enclosure extending upwardly from the bottom of the enclosure toward but not to the top of the enclosure dividing the enclosure into first, second and third liquid compartments for receiving a sealing liquid, a liquid trap connected to the first and third liquid compartments for maintaining liquid therein and preventing escape of gas, a third partition positioned in the enclosure extending downwardly from the top of the enclosure into the second liquid compartment dividing the enclosure into first and second gas compartments above the fluid compartments whereby gas can flow between said gas compartments only in response to certain pressure differences, a first port in the first gas compartment adapted for connection to said tank having vapor, a second port connected to the second gas compartment for admission and exit of gas from the second gas compartment, a gas scrubber connected to the second port for scrubbing vapor flowing into the first port and into the second gas compartment, and supplying sealing liquid through the second port to the second fluid compartment, a diluting fluid supply connected to the gas scrubber, and a bypass connection between the gas scrubber and the tank.

3. The apparatus of claim 2 including, a controller responsive to pressure in the tank controlling the admission of diluting fluid to the scrubber and controlling the opening of the bypass connection.

4. A liquid sealing apparatus for attachment to a tank having vapor therein for sealing the vapors comprising, an enclosure, first and second liquid partitions positioned in the enclosure extending upwardly from the bottom of the enclosure toward but not to the top of the enclosure dividing the enclosure into first, second and third liquid compartments for receiving a sealing liquid, a liquid trap connected to the first and third liquid compartments for maintaining liquid therein and preventing escape of gas, a third partition positioned in the enclosure extending downwardly from the top of the enclosure into the second liquid compartment dividing the enclosure into first and second gas compartments above the fluid compartments whereby gas can flow between said gas compartments only in response to certain pressure differences, said partition between the second and third liquid compartments extending upwardly greater than the partition between the first and second liquid compartments and extending upwardly greater than the bottom of the third partition for controlling the sealing pressure in said enclosure, a first port in the first gas compartment adapted for connection to said tank having vapor, and a second port connected to the second gas compartment for admission and exit of gas from the second gas compartment.

5. The apparatus of claim 4 wherein, the partition between the first and second liquid compartments extends upwardly greater than the bottom of the third partition.

6. A liquid sealing apparatus for attachment to a tank having vapor therein for sealing the vapors comprising, an enclosure, first and second liquid partitions positioned in the enclosure extending upwardly from the bottom of the enclosure toward but not to the top of the enclosure dividing the enclosure into first, second and third liquid compartments for receiving a sealing liquid, a liquid trap connected to the first and third liquid compartments for maintaining liquid therein and preventing escape of gas, a third partition positioned in the enclosure extending downwardly from the top of the enclosure into the second liquid compartment dividing the enclosure into first and second gas compartments above the fluid compartments whereby gas can flow between said gas compartments only in response to certain pressure differences, a first port in the first gas compartment adapted for connection to said tank having vapor, a second port connected to the second gas compartment for admission and exit of gas from the second gas compartment, an inert gas supply for connection to the tank for admission of inert gas into the tank, and control means responsive to the pressure in the tank for controlling the admittance of inert gas into the tank when the vapor pressure falls below a predetermined point, said control means includes means for admitting inert gas to the tank prior to the passage of gas from the second gas compartment to the first gas compartment thereby preventing the admission of atmospheric gas into the tank.

7. A liquid sealing apparatus for attachment to a tank having vapor therein for sealing the vapors comprising, an enclosure, first and second liquid partitions positioned in the bottom of the enclosure dividing the bottom of the enclosure into first, second and third liquid compartments for receiving a sealing liquid, a third partition positioned in the top of the enclosure dividing the top of the enclosure into first and second gas compartments above the liquid compartments, said third partition extending downwardly below the tops of the first and second partitions whereby liquid in the second liquid compartment forms a liquid seal between the first and second gas compartments, a liquid trap connected to the first and third liquid compartments for maintaining a liquid therein, a port in the first gas compartment adapted for connection to a tank having vapor, a liquid supply port connected to the second liquid compartment for supplying a sealing liquid, a gas scrubber connected to the enclosure for receiving and treating vapor in the second gas compartment, an inert gas supply for connection to the tank for admission of inert gas into the tank when the vapor pressure in the tank falls below atmospheric pressure, a steam supply connected to the scrubber, and a bypass connection between the scrubber and the tank for admission of steam to the tank upon the occurrence of a certain pressure.

8. The apparatus of claim 7 including, a controller responsive to pressure in the tank controlling the admission of inert gas and steam and controlling the opening of the bypass connection.

* * * * *